US005263913A

United States Patent [19]

Boren

[11] Patent Number: 5,263,913

[45] Date of Patent: Nov. 23, 1993

[54] EXERCISE MACHINE

[76] Inventor: John P. Boren, 9440 Old Katy Rd., Houston, Tex. 77055

[21] Appl. No.: 922,807

[22] Filed: Jul. 31, 1992

[51] Int. Cl.[5] ..... A63B 21/068

[52] U.S. Cl. ..... 482/96; 482/132; 482/142; 482/145; 482/95

[58] Field of Search ..... 482/131, 132, 142, 145, 482/96, 57, 72, 95, 135

[56] References Cited

U.S. PATENT DOCUMENTS

| | | | |
|---|---|---|---|
| 339,638 | 4/1886 | Goldie | 482/96 |
| 3,602,501 | 4/1970 | Garner | 482/145 |
| 3,709,488 | 1/1973 | Garner | 482/145 |
| 3,892,404 | 7/1975 | Martucci | 482/145 |
| 4,004,801 | 1/1977 | Campanaro et al. . | |
| 4,101,124 | 7/1978 | Mahnke | 482/145 |
| 4,176,836 | 12/1979 | Coyle | 482/96 |
| 4,316,608 | 2/1982 | Lundberg | 482/142 |
| 4,333,644 | 6/1982 | Lambert, Jr. et al. | 482/135 |
| 4,383,684 | 5/1983 | Schliep | 482/96 |
| 4,826,158 | 5/1989 | Fields, Jr. | 482/142 |
| 4,915,378 | 4/1990 | Abrahamian et al. | 482/145 |
| 4,930,769 | 6/1990 | Nenoff | 482/142 |

*Primary Examiner*—Richard J. Apley
*Assistant Examiner*—Lynne A. Rechard
*Attorney, Agent, or Firm*—Bush, Moseley & Riddle

[57] ABSTRACT

An exercise machine or apparatus (10) to permit a user (U) to perform a squatting exercise while supported in an inclined supine position on a slidable platform (12) which may be positioned at a predetermined inclination relative to the vertical by adjustment of the length of a diagonal leg (16) is disclosed. The movable platform (12) has bearing sleeves (64) mounted for sliding movement along fixed rods (60). Shoulder pads (78) on the platform (12) engage the shoulders of user (U) supported on the platform (12) with the feet of the user supported on a foot rest (52). Force exerted by the user (U) against the shoulder pads (78) by a pushing action of the feet from the bent position shown in FIG. 1 forces the platform (12) upwardly for straightening of the legs of the user (U). The vertical load exerted by the user (U) is determined by the inclination of the body support platform (12).

3 Claims, 2 Drawing Sheets

FIG. 5
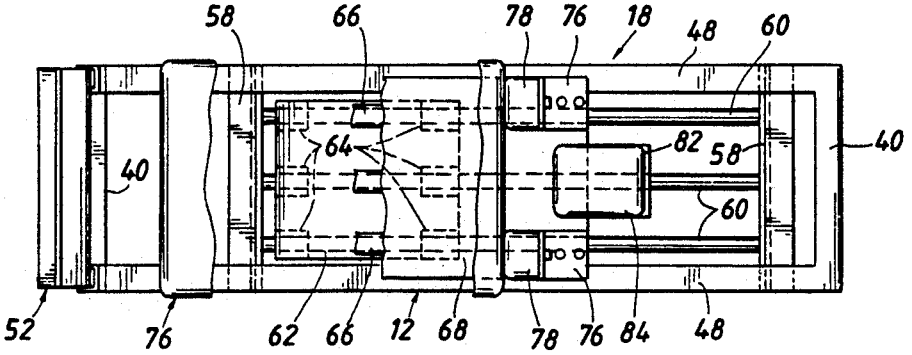
FIG. 4
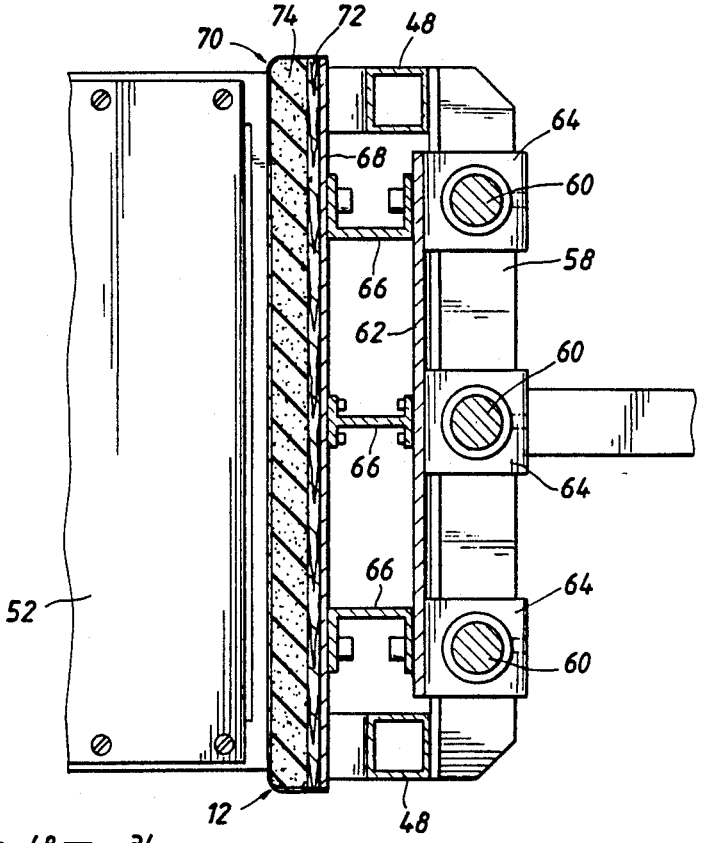
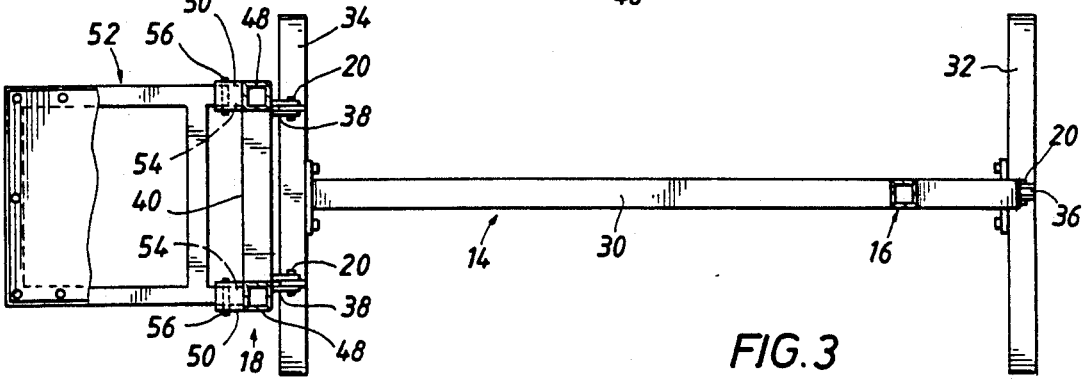
FIG. 3

EXERCISE MACHINE

FIELD OF THE INVENTION

This invention relates to an exercise machine, and more particularly to an exercise machine which permits a user to perform a squatting exercise movement while supported in an upright or in an inclined relation.

BACKGROUND OF THE INVENTION

Exercise is a general term which may imply a multitude of outcomes. Aerobic exercise is designed to increase heart rate, circulation and improve overall cardiovascular fitness. Muscular exercise is designed to increase muscular tonicity by either eccentric or concentric contraction movements. Some exercises are designed to combine both aerobic and muscular workouts to produce a more uniform fitness.

In the past 100 years a variety of devices and machines have been developed that are muscle specific and efficient in exercising a single muscle or muscle group. A void, however, has existed in novel equipment that effectively strengthens and improves muscular function in the lower extremities. Specifically this void involves the quadriceps, hamstrings and gluteal musculature. Although many machines have duplicated each other to work and exercise the hamstrings, quadriceps and gluteals, there exists no better exercise than the squat to exercise all three muscle groups simultaneously. A squat or a squat exercise movement refers to the vertical bending at the knees to simultaneously elongate the quadriceps, hamstrings and calf muscles. The reverse movement which involves straightening of the femur tibial joint produces contraction of the hamstrings, quadriceps and gluteal muscles.

Unfortunately the squat exercise movement that is done frequently in juvenile and adolescent development is seldom performed by adults. Therefore, unless a person actively engages in sports activities from adolescence into adulthood, it may be difficult for one to perform repetitive squats with as little as one's own body weight. Squat machines routinely load the spine and lower extremities in either the vertical or horizontal position. In adults, this loading may prove difficult if not impossible due to compromise of spine, hip, knee and ankle stability. Degenerative changes in the disc, cartilage and/or ligaments can restrict this exercise movement in overweight persons simply because of pain.

Ideally a squat exercise movement is best performed by adults without vertical loading using only the body weight of the individual. This is accomplished by standing upright with the feet spread to shoulder width when squatting downward until the backs of the legs are parallel to the ground. Again, even this non-weight bearing squat movement frequently cannot be performed, because the individual's upper body weight exceeds the loading capacity of the lower extremity muscles and joints.

SUMMARY OF THE INVENTION

This invention is particularly directed to an exercise machine in which the user is supported in an inclined supine position for performing a squatting exercise movement. Oftentimes, persons are unable to perform squatting movements as a result of their body weight which acts as a vertical load on the legs. If the body of a user is positioned at an angle inclined with respect to a vertical axis, the vertical load or effective weight of the user for performing a squatting exercise is reduced as a result of the inclination. The upper body or torso above the legs is supported by the exercise machine at an inclination of between around 30 degrees to 60 degrees which produces up to a maximum of around a 35 percent decrease in the vertical load from the user's upper body weight. Thus, this permits some people to perform a squatting exercise who were unable to perform squatting exercises heretofore. In addition, even for users who have been able to perform squatting exercises heretofore, increased repetitions of the squatting exercise may be achieved. The increase in the number of repetitions as a result of the decreased vertical load also permits an increased aerobic exercise.

The exercise machine or apparatus of the present invention comprises a generally triangular frame including a horizontal supporting base and a pair of upstanding diagonal legs or frame members pivotally connected to opposed ends of the base. The upwardly extending frame members have upper ends pivotally connected to each other to form the apex of the triangular frame. A sliding platform or carriage which is mounted on one of the diagonal frame members has a body support member for the upper body of a user in a supine position. The sliding platform has a pair of spaced shoulder pads thereon contacting the shoulders of a user. A foot rest is mounted adjacent the lower end of the sliding platform to support the feet of a user.

For a squatting exercise movement with the user supported in a supine position on the slidable platform with feet engaging the foot rest and legs in a straightened position, the platform moves downwardly by gravity from the weight of the user upon relaxation of the knees. The knees and legs bend in a squatting movement. At the end of the downward sliding movement, the user pushes upwardly with his or her feet against the foot rest and the shoulders of the user against the shoulder pads push the platform upwardly for straightening the legs of the user and for positioning the platform at a position for another repetition. The other diagonal frame member pivotally connected to the frame member supporting the platform is adjustable in length for varying the inclination of the sliding platform to a predetermined amount.

It is an object of this invention to provide an exercise machine which permits the user to perform a squatting exercise movement while supported in a near vertical or alternatively in an inclined position.

Another object of this invention is to provide such an exercise machine for a squatting exercise in which an increased repetition of the exercise is provided which results in increased aerobic exercising.

It is a further object of this invention to provide such an exercise machine which includes a reciprocable body support platform inclined at a predetermined vertical inclination for supporting the upper body of a user with feet supported on a fixed foot rest and shoulders contacting a shoulder restraint on the platform for forcing the platform upwardly upon pushing from the feet.

Other objects, features, and advantages of this invention will become more apparent after referring to the following specification and drawings.

BRIEF DESCRIPTION OF THE DRAWINGS

FIG. 3 is a plan view of the lower base support taken generally along line 3—3 of FIG. 1;

FIG. 4 is a section taken generally along line 4—4 of FIG. 1 and showing a slidable body support platform; and FIG. 5 is a front elevation taken generally along line 5—5 of FIG. 1 and showing the body support platform with certain portions thereof broken away.

DESCRIPTION OF THE INVENTION

Figure 1:
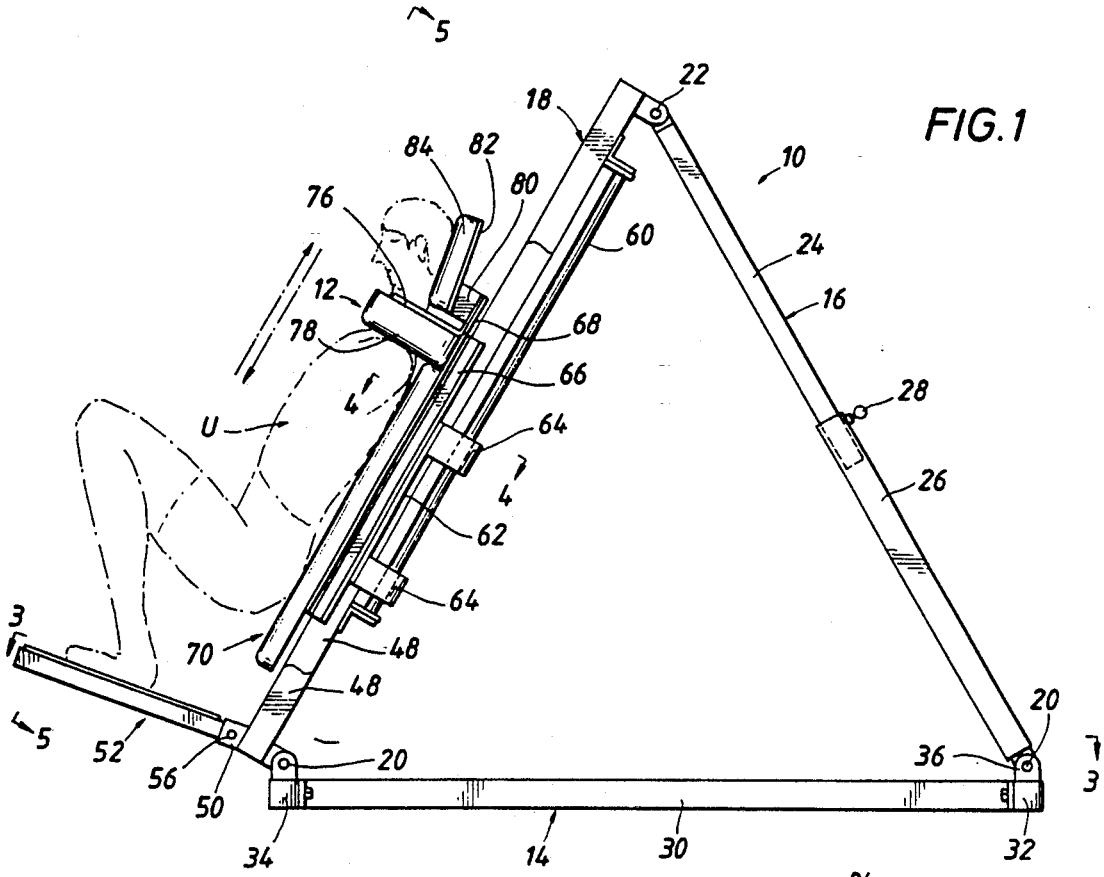
FIG. 1 is a side elevation of the exercise machine of the present invention showing a user in a supine relation supported on a reciprocable body support platform with the platform shown in a downward position for a squatting exercise movement with knees of the user bent.
Figure 2:
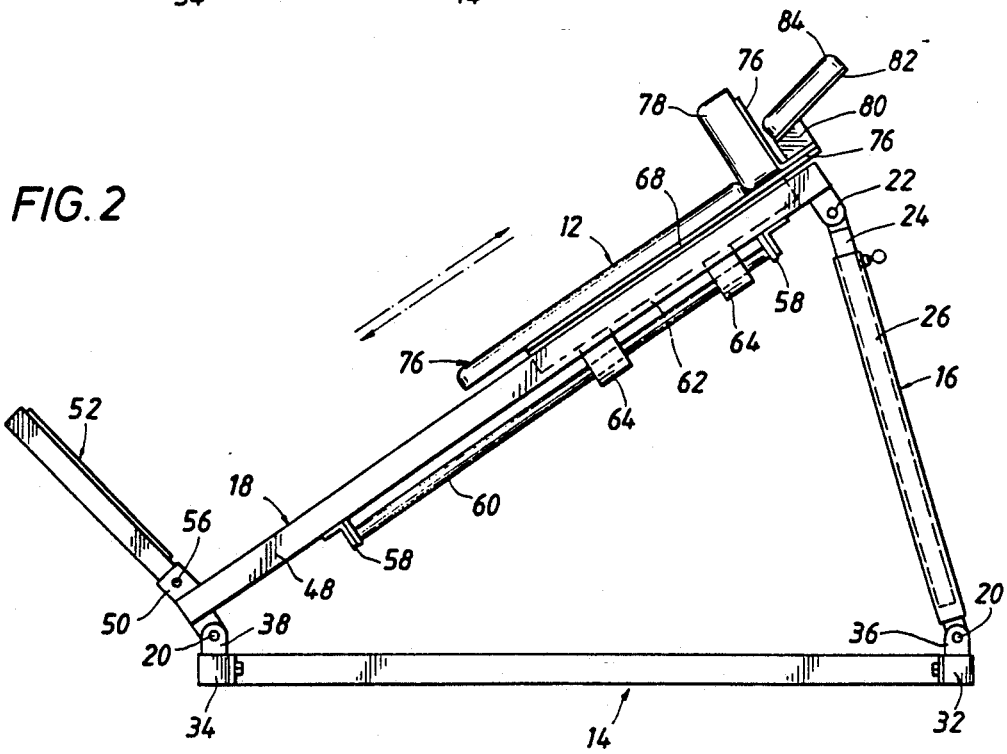
FIG. 2 is a side elevation similar to FIG. 1 but showing the platform in an extended upper position without the user thereon and showing the platform in a more inclined orientation at a greater angle than that shown in FIG. 1.

Referring now to the drawings for a better understanding of this invention, and more particularly to FIGS. 1 and 2, the exercise machine or apparatus of this invention is shown generally at 10 and has a user shown at U supported in a supine relation on a slidable platform or carriage generally indicated at 12 for performing a squatting exercise with the platform 12 and user U shown in a downward position with the knees bent. Platform 12 is mounted on a support or frame of a generally triangular shape comprising a horizontal support base generally indicated at 14 and upwardly extending diagonal legs shown generally at 16 and 18 pivotally connected at 20 to opposed ends of support base 14. Legs 16 and 18 are pivotally connected at 22 to each other to form an apex of the generally triangular frame or support.

Leg 16 has inner and outer telescoping portions 24, 26 and may be adjusted in length by adjustment of adjusting screw 28 which changes the inclination of legs 16 and 18 as illustrated in FIG. 2 in which leg 16 is shown in a retracted or shortened position relative to FIG. 1. Base 14 as shown particularly in FIG. 3 includes a longitudinally extending base frame member 30 having transverse extending end base frame members 32 and 34 secured thereto. End member 32 has a bracket 36 thereon which forms a pivot 20 for leg 16. End member 34 has brackets 38 thereon which form pivots 20 for diagonal leg 18.

Diagonal leg 18, as shown also in FIGS. 4 and 5, has a generally rectangular frame comprising end frame members 40 and integral side frame members 48. Open ended sleeves or sockets 50 are secured to the lower end of side frame members 48. A foot rest or support generally indicated at 52 has extending end portions 54 which are received within sockets 50 and removably connected thereto by suitable fasteners indicated at 56. Extending between side frame members 48 are a pair of angle-shaped cross supports 58 having a plurality of spaced parallel support rods 60 secured therebetween. Sliding platform 12 is mounted on rods 60 for reciprocation along rods 60. A lower base support plate 62 of slidable platform 12 has lower and upper bearing sleeves 64 secured thereto which receive rods 60 to mount slidable platform 12. Longitudinally extending support members 66 are secured between lower support plate 62 and an upper support plate 68. A body support pad or back rest generally indicated at 70 is secured to upper support plate 68 and includes a lower wooden or fiberglass backing panel 72 and a polyurethane foam pad 74 secured to back panel 72. A pair of upper spaced angle supports 76 are secured to upper support plate 68, and shoulder pads 78 are secured to extending legs of angle supports 76. A bracket 80 extends from upper support plate 68 and has a support plate 82 secured thereto. A head rest or pad 84 is secured to support plate 82.

OPERATION

FIG. 1 shows user U supported on slidable platform 12 at the lower end of a squatting exercise movement in which the upper body portion is in a supine position on platform 12 and the knees and legs of the user are bent. From this position, the user pushes upwardly with his or her shoulders against shoulder pads 78 while restrained by foot rest 52 to exert an upward force against shoulder pads 78 and platform 12 to move platform 12 to the upper position as shown in FIG. 2 thereby to complete an exercise cycle. In the downward movement, the user U relaxes his or her legs and knees and the vertical load from the upper body portion of the user results in a downward movement of the user and platform 12 along rods 60 by gravity. A minimum friction is obtained by bearing sleeves 64 sliding along fixed rods 60. Thus, the effective body weight or vertical load which acts in a vertical direction may be reduced by the inclined relation of the upper body portion of the user. As much as around a 30 to 35 percent decrease in the vertical load of a user may be obtained which permits some people to perform a squatting exercise which could not be performed in a vertical direction. As shown in FIG. 2, platform 12 is at an incline angle of around 30 percent with respect to a horizontal plane and when the incline angle is increased, an increased force is required for performing the squatting exercise movement. Increased repetitions of the squatting exercise may also be obtained as the result of a decrease in vertical load as less force is required to move the body in a squatting movement when the vertical load is decreased.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. An exercise machine supporting a user in an inclined supine relation for performing a squatting exercise movement; said exercise machine comprising:

a generally triangular support frame including a generally horizontal fixed base adapted to be supported on a supporting surface and a pair of opposed pivot supports at opposite ends of said base, a pair of upwardly extending diagonal frame members pivotally connected to said pivot supports and having upper ends pivotally connected to each other, one of said diagonal frame members being a body support frame member and the other of said diagonal frame members adapted to vary selectively the inclination of said body support frame member;

a foot rest positioned adjacent the lower end of said body support frame member adapted to support the feet of a user and to restrain movement of the feet during the squatting exercise movement;

a body support platform mounted on said body support frame member for reciprocating movement and having a shoulder restraint thereon adapted to contact the shoulder of a user in an inclined supine position on the platform whereby the user in a lower squatting position exerts force against said shoulder restraint and is restrained by said foot rest for moving said body support platform in an upward direction for straightening of the legs of the user, the user and platform moving in a downward direction by gravity upon bending of the knees and relaxing of the body while being restrained by said foot rest; and adjustable means to selectively vary the length of said other frame member for varying the inclination of said body support frame and body support platform thereby to vary the effective weight of the user when performing a squatting exercise.

2. An exercise machine as set forth in claim 1 wherein a plurality of parallel support rods are mounted on said body support frame member; and said body support platform has a plurality of sleeves thereon mounted on said support rods for sliding movement therealong thereby to provide reciprocation of said body support platform relative to said body support frame member.

3. An exercise machine as set forth in claim 2 wherein said other diagonal frame member comprises a pair of telescoping portions and said adjustable means comprises means to adjust the length of said telescoping portions.

* * * * *